US010149522B1

(12) United States Patent
Persley

(10) Patent No.: US 10,149,522 B1
(45) Date of Patent: Dec. 11, 2018

(54) MULTI-FUNCTIONAL WALKING CANE AND ASSOCIATED USE THEREOF

(71) Applicant: Rose Persley, Beaumont, TX (US)

(72) Inventor: Robert Persley, Beaumont, TX (US)

( * ) Notice: Subject to any disclaimer, the term of this patent is extended or adjusted under 35 U.S.C. 154(b) by 208 days.

(21) Appl. No.: 15/203,768

(22) Filed: Jul. 6, 2016

Related U.S. Application Data

(60) Provisional application No. 62/188,763, filed on Jul. 6, 2015.

(51) Int. Cl.

| | |
|---|---|
| ***A45B 3/00*** | (2006.01) |
| ***A45B 9/04*** | (2006.01) |
| ***A47F 13/06*** | (2006.01) |
| ***B25J 1/04*** | (2006.01) |
| *A45B 9/00* | (2006.01) |

(52) U.S. Cl.
CPC ..... *A45B 3/00* (2013.01); *A45B 9/04* (2013.01); *A47F 13/06* (2013.01); *B25J 1/04* (2013.01); *A45B 2009/002* (2013.01)

(58) Field of Classification Search
CPC ..... A45B 3/00; A45B 2009/002; A45B 9/04; E04H 2001/1293; B25J 1/04; A47F 13/06
See application file for complete search history.

(56) References Cited

U.S. PATENT DOCUMENTS 1,905,076 A * 4/1933 Van Sciver ..... A45B 3/00 135/66
2,346,038 A * 4/1944 Mason ..... A45B 3/00 135/66
2,836,188 A * 5/1958 Lee ..... A45B 3/00 135/66
3,093,402 A * 6/1963 Sisson ..... A45B 3/00 135/65
3,265,429 A * 8/1966 Shatt ..... B25J 1/04 294/104
5,176,160 A * 1/1993 Osborn ..... A45B 3/00 135/66
5,392,800 A * 2/1995 Sergi ..... A45B 3/00 135/65
5,433,234 A * 7/1995 Lapere ..... A45B 3/00 135/66
5,636,650 A * 6/1997 Kroeze ..... A45B 3/00 135/66

(Continued)

FOREIGN PATENT DOCUMENTS

DE 29704534 U1 * 5/1997 ..... E01H 1/1206
EP 1707067 A1 * 10/2006 ..... A45B 3/00

(Continued)

*Primary Examiner* — David R Dunn
*Assistant Examiner* — Danielle Jackson
(74) *Attorney, Agent, or Firm* — Ashkan Najafi

(57) ABSTRACT

A multi-functional walking cane includes a body having a cavity provided with a centrally registered longitudinal axis, a proximal end and a distal end opposed therefrom, and a handle disposed at the proximal end. An object-grabbing mechanism is in operable communication with the body. Such an object-grabbing mechanism has an object-grabbing section seated exterior of the body. Advantageously, the object-grabbing section is configured to resiliently deploy between a retracted equilibrium position and an expanded tensioned position, respectively, upon receiving a corresponding user input.

13 Claims, 8 Drawing Sheets

(56) References Cited

U.S. PATENT DOCUMENTS 5,640,985 A * 6/1997 Snyder ..... A45B 3/00 135/65
5,707,303 A * 1/1998 Berkowitz ..... A45B 3/00 294/19.2
5,755,245 A * 5/1998 Van Helvoort ..... A45B 3/00 135/65
6,058,953 A * 5/2000 Stefanelli ..... A45B 3/00 135/66
6,508,496 B1 * 1/2003 Huang ..... E01H 1/12 294/115
6,550,490 B1 * 4/2003 Morton ..... A45B 3/00 135/65
7,219,679 B2 * 5/2007 Hsu ..... B26B 13/24 135/65
7,243,668 B1 * 7/2007 Kroeze ..... A45B 3/00 135/66
8,381,748 B2 * 2/2013 Martin ..... A45B 3/00 135/66
8,939,481 B1 * 1/2015 Qi ..... E01H 1/1206 294/1.4
8,978,677 B2 * 3/2015 Roberts ..... A45B 3/00 135/66
9,161,595 B2 * 10/2015 Riemer ..... A45B 3/04
9,277,794 B2 * 3/2016 Moreau ..... A45B 9/00
9,370,226 B2 * 6/2016 Dole ..... A45B 3/00
9,770,079 B1 * 9/2017 Menn ..... A45B 3/00
2004/0040588 A1 * 3/2004 Parigian ..... A45B 3/00 135/66
2008/0128009 A1 * 6/2008 Blake ..... A45B 3/04 135/75
2008/0149155 A1 * 6/2008 Martin ..... A45B 1/04 135/66
2009/0032077 A1 * 2/2009 Hines ..... A45B 3/00 135/66
2012/0060878 A1 * 3/2012 Thiessens ..... A45B 1/04 135/66
2013/0257072 A1 * 10/2013 Chrysler ..... A45B 3/00 294/116
2015/0305452 A1 * 10/2015 Martinez ..... A45B 3/00 135/66
2017/0196322 A1 * 7/2017 Denmark ..... A45B 9/04

FOREIGN PATENT DOCUMENTS

FR 2578401 A1 * 9/1986 ..... A45B 3/00
WO WO-2017068207 A1 * 4/2017 ..... A45B 3/00

* cited by examiner

MULTI-FUNCTIONAL WALKING CANE AND ASSOCIATED USE THEREOF

CROSS REFERENCE TO RELATED APPLICATIONS

This is a non-provisional patent application that claims the benefit of U.S. provisional patent application No. 62/188,763 filed Jul. 6, 2015, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to walking canes and, more particularly, to a walking cane featuring an object-grabbing mechanism incorporated therein for assisting a user to reach and pick up items that may be too high or on the floor.

Prior Art

With today's heightened awareness of health concerns and constantly improving medical care, Americans are living longer than ever before. As the baby boomer generation gets older, dramatic increases are expected in the elderly population. In fact, the U.S. Bureau of the Census estimates that people 65 and older will comprise 20.4 percent of the country's population by the year 2030, up from the current 13 percent. However, if the unprecedented increase in life expectancy has a downside, it is the exposure of risk to chronic age-related disorders. Such serious ailments as diabetes, Alzheimer's and Parkinson's diseases are but a few of the disabling disorders that keep many older persons from enjoying their longevity.

Additionally, the elderly also has to deal with physical infirmities brought on by the inevitability of aging. The scientific journal Age and Aging reports that some 50% of persons over age 65 have osteoarthritis, and one-half of those are seriously disabled by the disease. However, challenges presented to those with limited mobility are not exclusive to the elderly. According to other statistics provided by the Census Bureau, nearly 8 percent of Americans between the ages of 15 and 64 suffer from some form of disability that hinders independent movement. Adding to these numbers are those with more temporary ailments, such as broken bones or postoperative conditions.

Whether one suffers from arthritic conditions or a fractured ankle, U.S. residents who have difficulty walking make up a significant segment of the country' s population. In fact, according to statistics from the U.S. Census Bureau, 9.4% of Americans have difficulty walking; of this number, 3.1% rely on a cane, crutches, or a walker to assist in their mobility endeavors. Perhaps the most common, and definitely the most non-cumbersome, of the three is the walking cane. Usually fashioned from wood or aluminum, the cane is essentially an upright stick featuring a looped handle for easy holding as well as a rubberized tip to provide traction while in use. Yet, as effective as canes can be to help increase one's mobility, their use can be quite challenging. When in use, canes keep a person upright; without support of a canes, the user can easily fall and risk exacerbating their disability or injury. As such, should a cane user drop a needed item, such as car keys, a cell phone, or a prescription medication bottle, he or she must hope for a table or chair to lend support, or the help of another person, to retrieve the item. Additionally, it can be quite difficult for cane users to reach upward for items.

Accordingly, a need remains for a multi-functional walking cane in order to overcome at least one prior art shortcoming. The exemplary embodiment(s) satisfy such a need by providing a multi-functional walking cane featuring an object-grabbing mechanism incorporated therein that is convenient and easy to use, lightweight yet durable in design, versatile in its applications, and designed for assisting a user to reach and pick up items that may be too high or on the floor.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a multi-functional walking cane for assisting a user to reach and pick up objects that may be too high or on the floor. These and other objects, features, and advantages of the non-limiting exemplary embodiment(s) are provided by a multi-functional walking cane including a body having a cavity provided with a centrally registered longitudinal axis, a proximal end and a distal end opposed therefrom, and a handle disposed at the proximal end. An object-grabbing mechanism is in operable communication with the body. Such an object-grabbing mechanism has an object-grabbing section seated exterior of the body. Advantageously, the object-grabbing section is configured to resiliently deploy between a retracted equilibrium position and an expanded tensioned position, respectively, upon receiving a corresponding user input.

In a non-limiting exemplary embodiment, the object-grabbing mechanism includes an actuator extending out from the proximal end of the body, and a shaft having a proximal end seated within the cavity and connected to the actuator. Such a shaft further has a distal end provided with a serrated outer surface seated exterior of the body. A resilient spring is concentrically wound about the shaft, wherein the spring is configured to compress to a tensioned position and thereafter automatically return to an expanded equilibrium position when the actuator is linearly displaced inwardly and outwardly from the shaft, respectively. Notably, the object-grabbing section is located at the distal end of the body and rotatably coupled to the serrated outer surface of the distal end of the shaft. In this manner, the actuator, the spring and the shaft are contemporaneously reciprocated along the centrally registered longitudinal length of the body such that the grabbing section is pivotally displaced between the retracted equilibrium position and an expanded tensioned position, respectively.

In a non-limiting exemplary embodiment, the object-grabbing section further includes a plurality of grabbing members each having a curvilinear interior surface and a drive gear statically affixed thereto. A plurality of brackets are fixedly connected to the distal end of the body. Notably, a plurality of pivot pins are transversely interfitted through the drive gears respectively, and mated to the brackets, respectively. Advantageously, the grabbing members are equidistantly and symmetrically offset from the centrally registered longitudinal axis. Thus, each of the drive gear maintains continuous contact with the serrate outer surface of the shaft.

In a non-limiting exemplary embodiment, the grabbing members are contemporaneously pivoted in sync about the pivot pins and along mutually exclusive arcuate travel paths, respectively.

In a non-limiting exemplary embodiment, each of the grabbing members are registered substantially parallel to the centrally registered longitudinal axis when the actuator is at a released equilibrium position and the shaft is at a retracted equilibrium position.

In a non-limiting exemplary embodiment, each of the grabbing members are angularly registered relative to the centrally registered longitudinal axis when the actuator is at a depressed tensioned position and the distal end of the shaft is displaced outwardly away from the distal end of the body.

In a non-limiting exemplary embodiment, each of the grabbing members further includes a substantially triangular-shaped wedge coupled to the interior surface thereof and radially extended towards the centrally registered longitudinal axis.

In a non-limiting exemplary embodiment, each of the triangular-shaped wedges has a lateral side respectively conjoined and spaced apart from an adjacent one of the triangular-shaped wedges when the grabbing members are at the retracted equilibrium position and the expanded tensioned position, respectively.

The present disclosure further includes a method of utilizing a multi-functional walking cane for assisting a user to reach and pick up objects that may be too high or on the floor.

Such a method includes the chronological steps of: providing a body including a cavity having a centrally registered longitudinal axis, a proximal end and a distal end opposed therefrom, and a handle disposed at the proximal end; providing an object-grabbing mechanism having an object-grabbing section seated exterior of the body; operably communicating the object-grabbing mechanism with the body; and resiliently deploying the object-grabbing section between a retracted equilibrium position and an expanded tensioned position, respectively.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
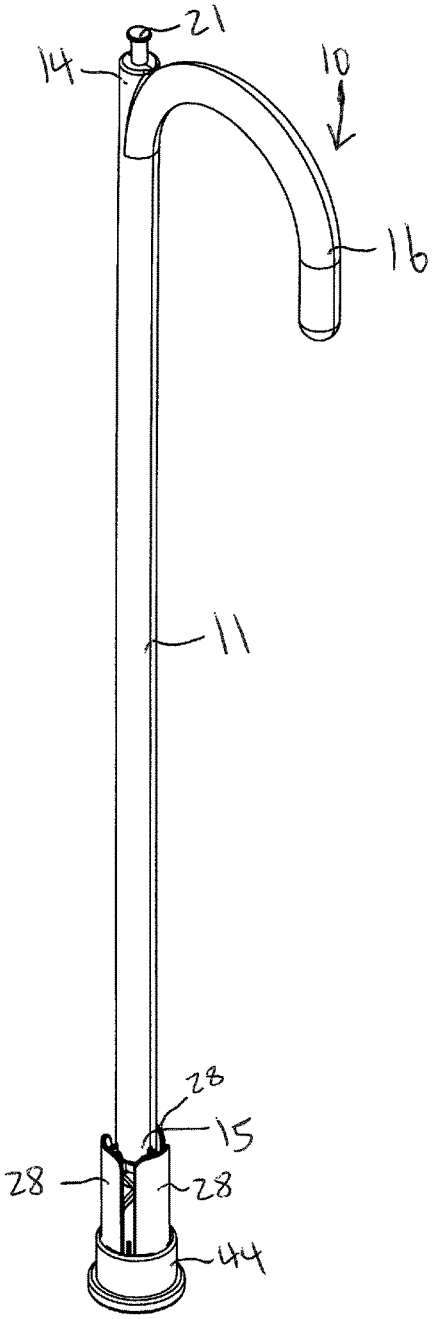
FIG. 1 is a perspective view illustrating a multi-functional walking cane having an object-grabbing mechanism having grabbing members resting at a retracted, equilibrium position, in accordance with a non-limiting exemplary embodiment.
Figure 2:
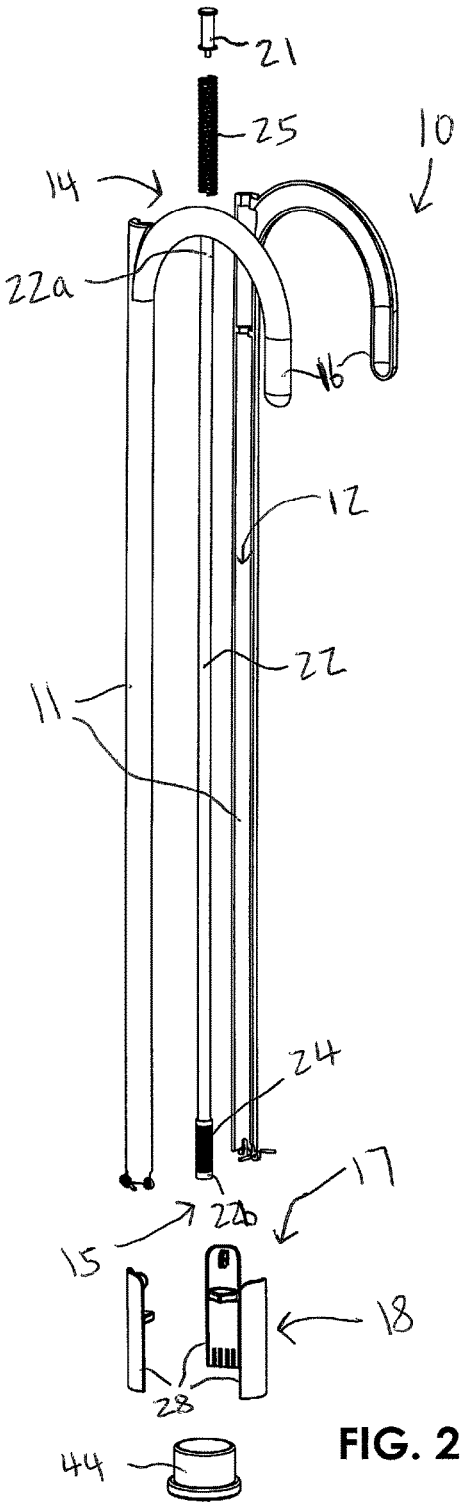
FIG. 2 is an exploded view of the multi-functional walking cane shown in FIG. 1.
Figure 2A:
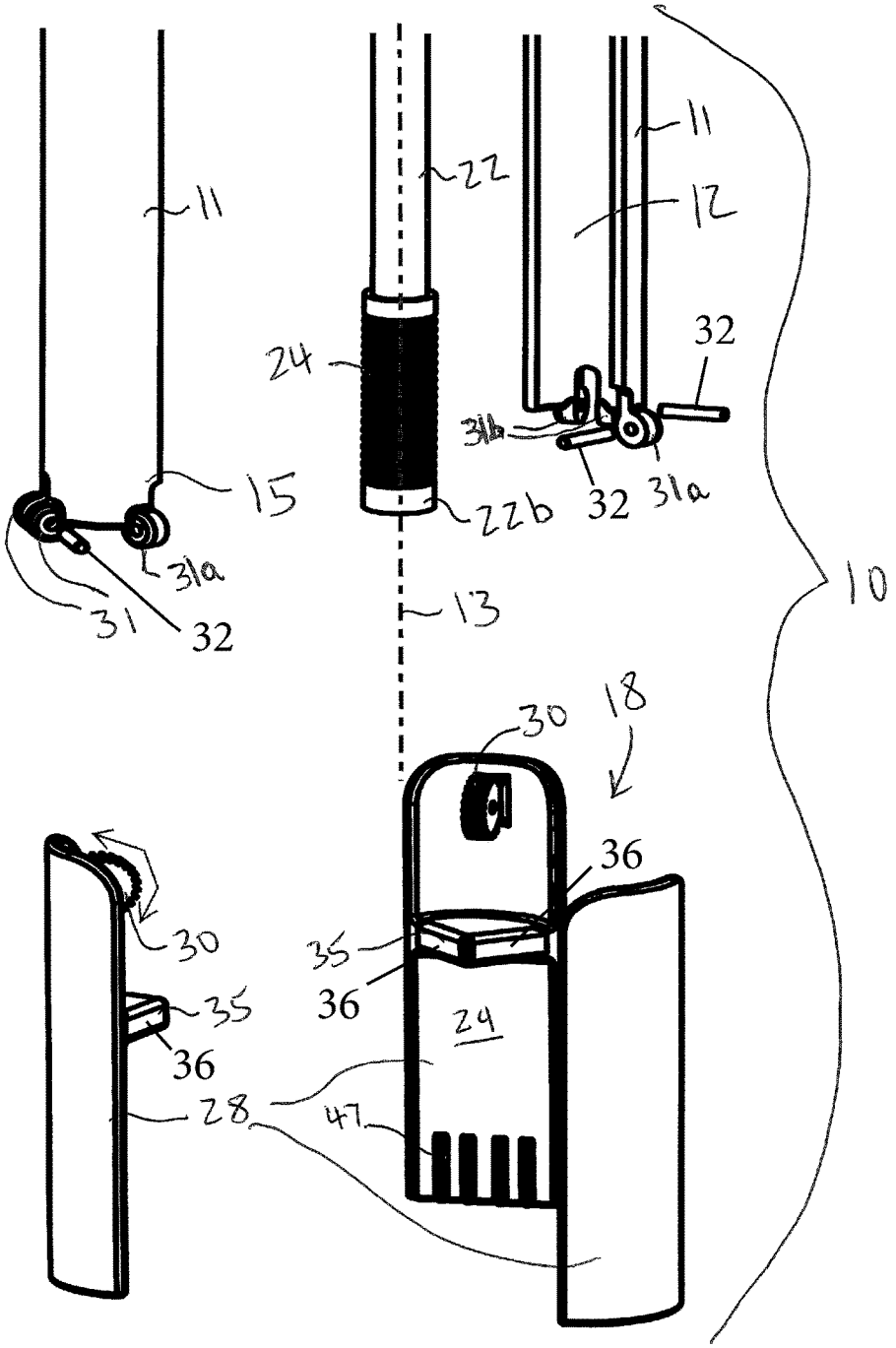
Figure 3:
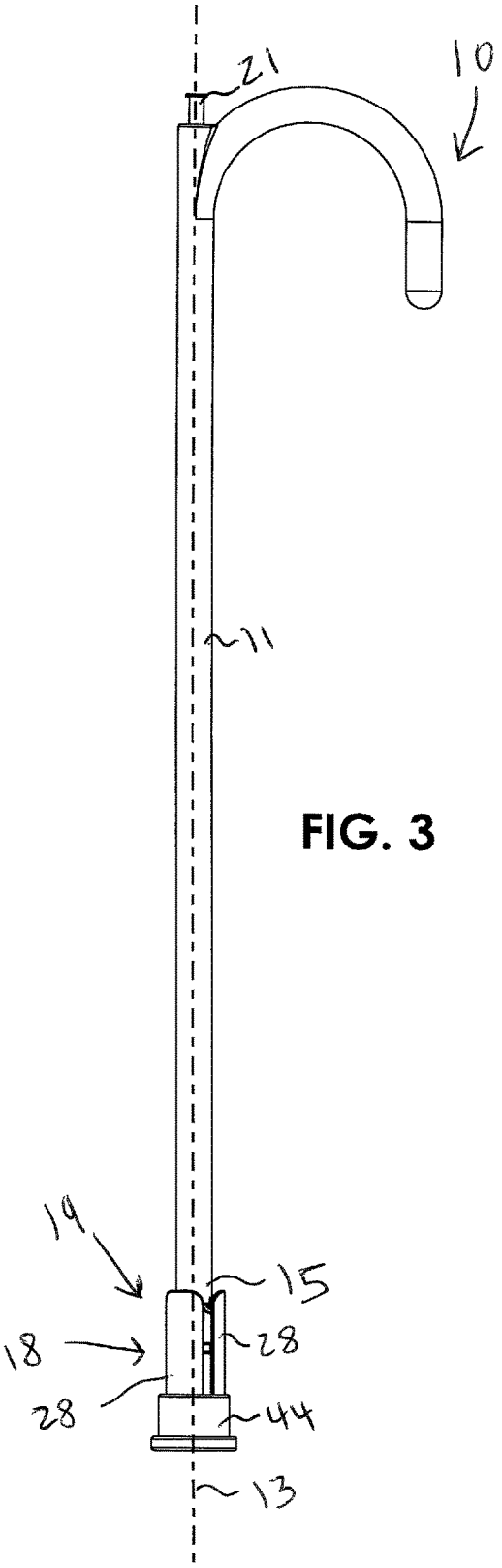
Figure 4:
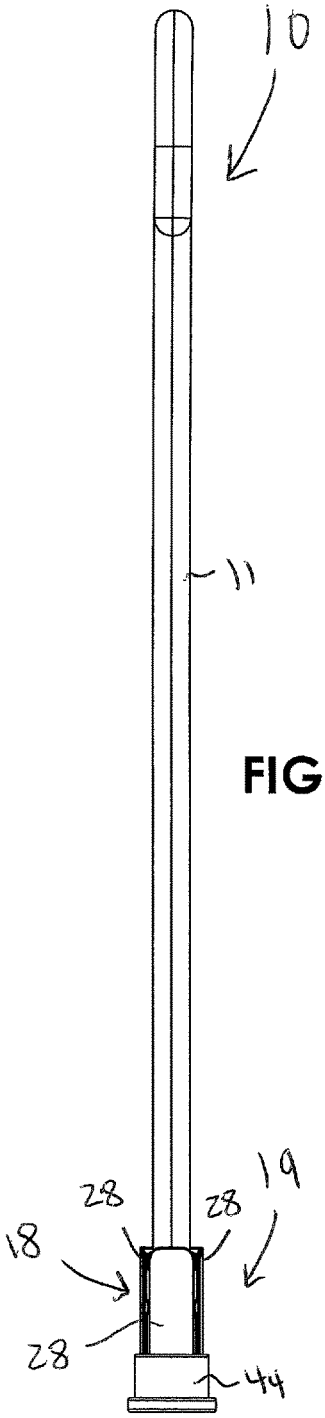
Figure 5:
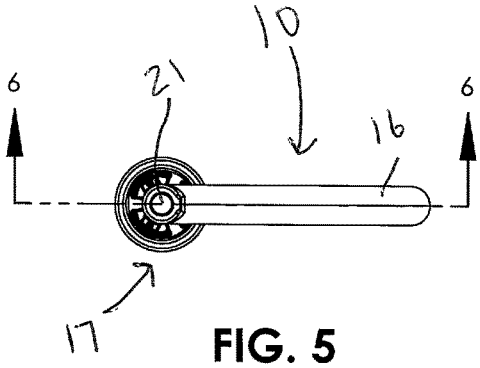
Figure 6:
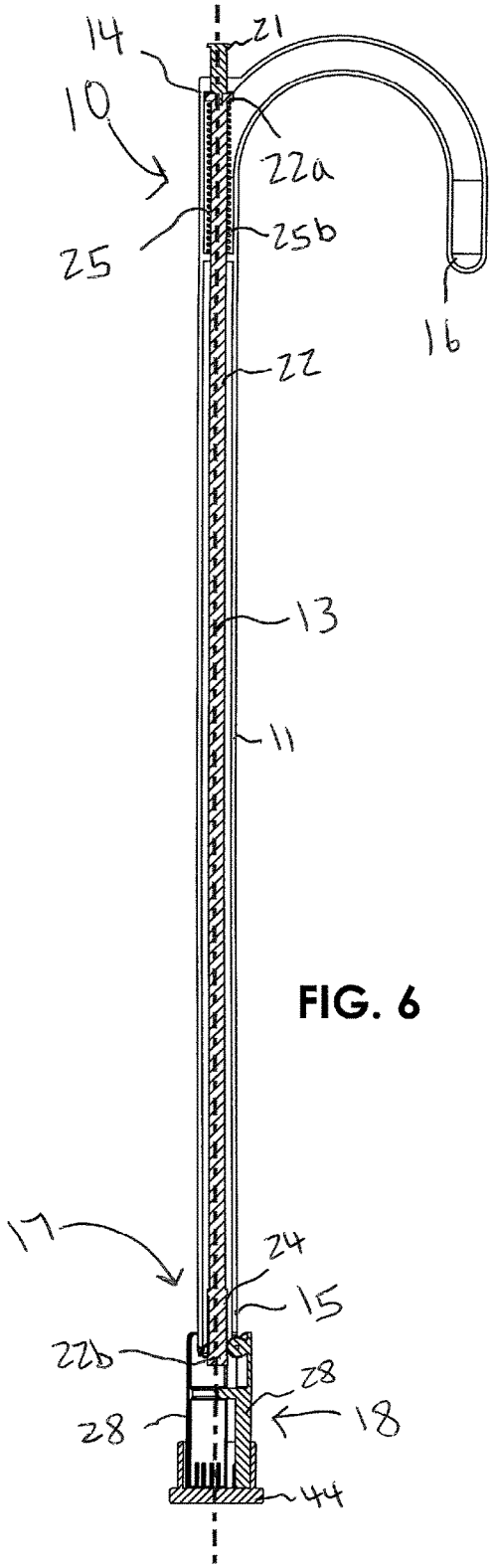
Figure 6A:
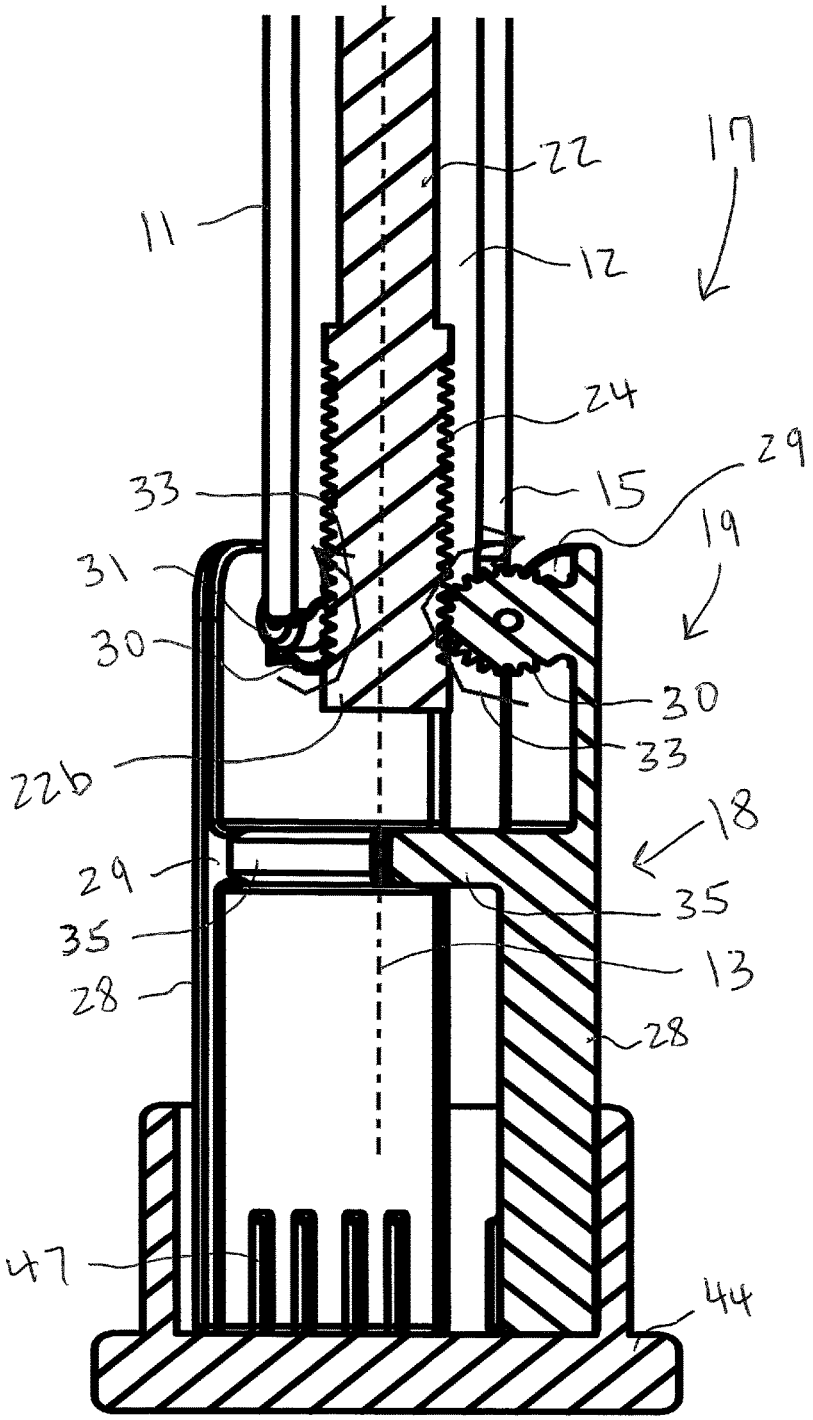
Figure 7:
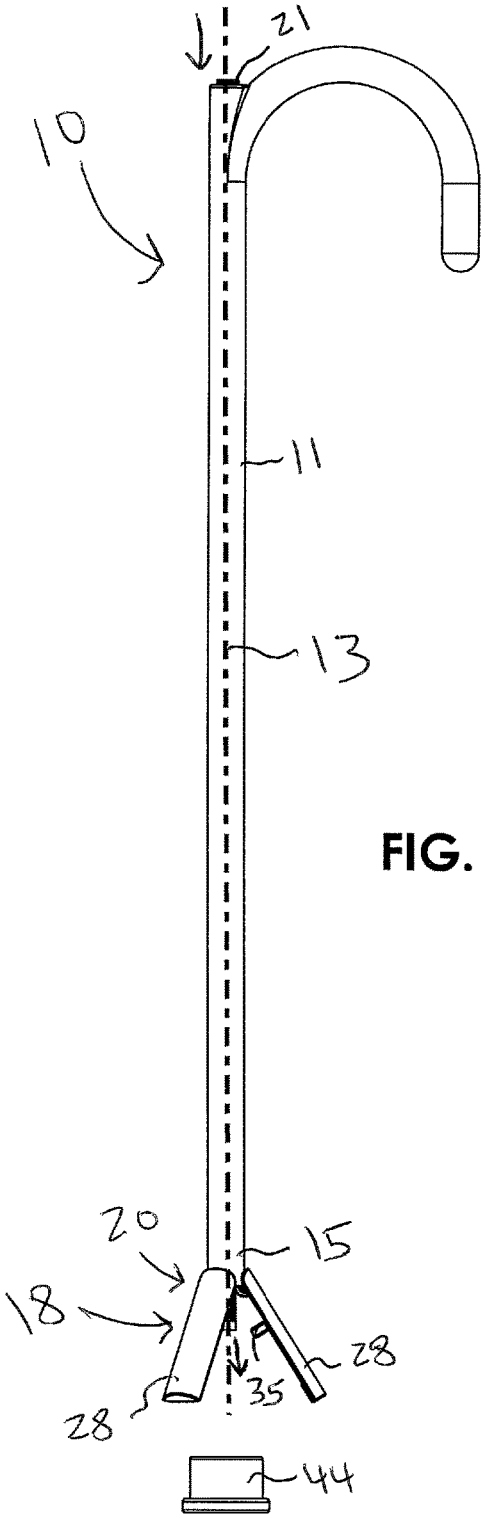
Figure 8:
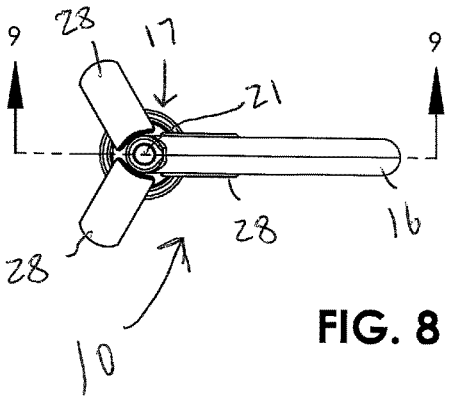
Figure 9:
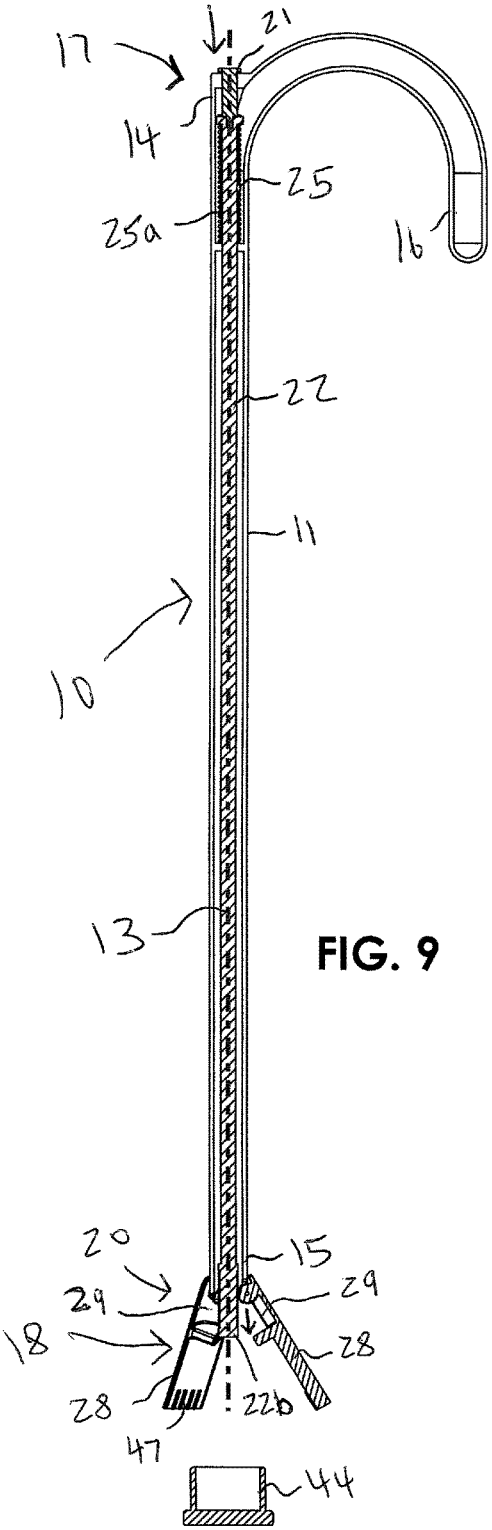
Figure 9A:
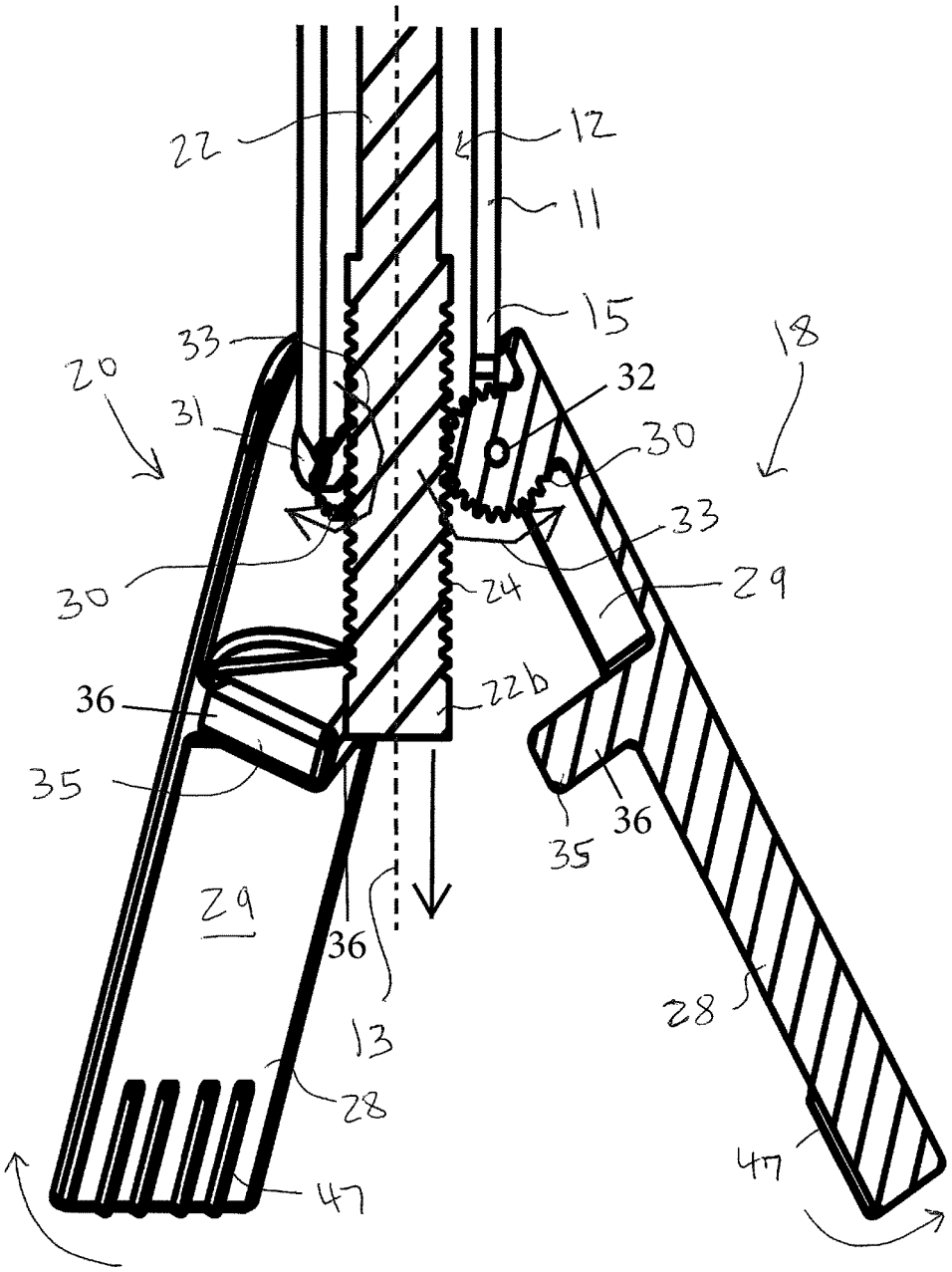

FIG. 2*a* is an enlarged partial view of the brackets and grabbing members illustrated in FIG. 2;

FIG. 3 is a side elevational view of the multi-functional walking cane shown in FIG. 1;

FIG. 4 is a front elevational view of the multi-functional walking cane shown in FIG. 1;

FIG. 5 is a top plan view of the multi-functional walking cane shown in FIG. 1;

FIG. 6 is a cross-sectional view taken along line 6-6 in FIG. 5;

FIG. 6*a* is an enlarge partial view showing the operational interrelationship between the shaft, brackets and grabbing members resting at the retracted, equilibrium position;

FIG. 7 is a side elevational view of the multi-functional walking cane wherein the grabbing members are deployed to an expanded, tensioned position;

FIG. 8 is a top plan view of the multi-functional walking cane shown in FIG. 7;

FIG. 9 is a cross-sectional view taken along line 9-9 in FIG. 8; and FIG. 9*a* is an enlarged partial view showing the operational interrelationship between the shaft, brackets, and grabbing members deployed to the expanded, tensioned position.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means ±15% of the numerical.

If used herein, "substantially" means largely if not wholly that which is specified but so close that the difference is insignificant.

The non-limiting exemplary embodiment(s) is/are referred to generally in FIGS. 1-9*a* and is/are intended to provide a multi-functional walking cane 10 for assisting a user to reach and pick up objects that may be too high or on the floor. The multi-functional walking cane 10 includes a body 11 having a cavity 12 provided with a centrally registered longitudinal axis 13, a proximal end 14 and a distal end 15 opposed therefrom, and a handle 16 disposed at the proximal end 14. An object-grabbing mechanism 17 is in operable communication with the body 11. Such an object-grabbing mechanism 17 has an object-grabbing section 18 seated exterior of the body 11. Advantageously, the object-grabbing section 18 is configured to resiliently deploy (articulate) between a retracted, equilibrium position 19 (FIGS. 1, 3-6*a*) and an expanded tensioned position 20 (FIGS. 7-9*a*), respectively, upon receiving a corresponding user input. Such a structural configuration provides the unexpected and unpredictable advantage of deploying and retracting object-grabbing mechanism 17 without adjusting a user grip of the cane 10 during a walk.

In a non-limiting exemplary embodiment, an end cap 44 is removably affixed to the object-grabbing section 18 thereby providing a support to engage a ground surface during the walk while preventing premature deployment of the object-grabbing section 18. The end cap 44 can be manually removed and attached to the object-grabbing section 18.

In a non-limiting exemplary embodiment, the object-grabbing mechanism 17 includes an actuator 21 extending out from the proximal end 14 of the body 11, and a shaft 22 having a proximal end 22*a* seated within the cavity 12 and connected to the actuator 21. Such a shaft 22 further has a distal end 22*b* provided with a serrated outer surface 24 (e.g. circumferential outer surface) partially seated exterior of the body 11. A resilient spring 25 is concentrically wound about the shaft 22, wherein the spring 25 is configured to compress to a tensioned position 25*a* (FIGS. 7-9*a*) and thereafter automatically decompress to an equilibrium position 25*b* (FIGS. 1, 3-6) when the actuator 21 is linearly displaced inwardly and outwardly from the shaft 22, respectively. Such linear displacement occurs along centrally registered longitudinal axis 13. Notably, the object-grabbing section 18 is located at the distal end 15 of the body 11 and rotatably coupled to the serrated outer surface 24 of the distal end 22*b* of the shaft 22. In this manner, the actuator 21, the spring 25 and the shaft 22 are contemporaneously reciprocated in sync along the centrally registered longitudinal axis 13 of body 11 such that the grabbing section 18 is pivotally displaced (articulated) between the retracted equilibrium position 19 (FIGS. 1, 3-6*a*) and an expanded tensioned position 20 (FIGS. 7-9*a*), respectively. Such a structural configuration provides the unexpected and unpredictable advantage of automatically and contemporaneously retracting the object-grabbing section 18 to the retracted equilibrium position 19 by simply releasing actuator 21 with a single metacarpal while maintaining a hand grip on the cane 10 (e.g., handle 16). There is no need to readjust the user grip or use another hand to actuate the object-grabbing section 18.

In a non-limiting exemplary embodiment, the object-grabbing section 18 further includes a plurality of grabbing members 28 each having a curvilinear interior surface 29 and a drive gear 30 statically affixed thereto. Optionally, protrusions 47 may be employed to provide frictional contact with the target object. It is noted that each grabbing member 28 has a corresponding curvilinear interior surface 29 and drive gear 30. A plurality of brackets (bracket pairs 31, 31*a*, 31*b*) are fixedly connected to the distal end 15 of the body 11. Such bracket pairs 31, 31*a*, 31*b* are configured such that each drive gear 30 is intercalated between a corresponding bracket pair 31, 31*a*, 31*b*. Notably, a plurality of pivot pins 32 are transversely interfitted through the drive gears 30, respectively, and mated to the brackets pairs 31, 31*a*, 31*b*, respectively. In this manner, the brackets pairs 31, 31*a*, 31*b* are supports for stabilizing the grabbing members 28 during deployment and retraction. Advantageously, the grabbing members 28 are equidistantly and symmetrically offset from the centrally registered longitudinal axis 13. Thus, each of the drive gears 30 maintains continuous contact with the serrated outer surface 24 of the shaft 22. Such a structural configuration provides the unexpected and unpredictable advantage of ensuring each of the grabbing members 28 pivotally articulates in sync without becoming undesirably separated from body 11 and/or shaft 22.

In a non-limiting exemplary embodiment, the grabbing members 28 are contemporaneously pivoted in sync about pivot pins 32 and along mutually exclusive arcuate travel paths 33, respectively. It is noted that each arcuate travel path 33 is associated with a corresponding one of the drive gears 30. Although, all three arcuate paths 33 are not illustrated, one skilled in the art understands each arcuate travel path 33 is unique and non-overlapping with an adjacent drive gear 30. Such a structural configuration provides the unexpected and unpredictable advantage of applying a uniform initial torque or initial frictional force to pivotally deploy each grabbing member 28 equidistantly away from body 11 and shaft 22.

In a non-limiting exemplary embodiment, referring to FIGS. 1, 3-6*a*, each of the grabbing members 28 are registered substantially parallel to the centrally registered longitudinal axis 13 when the actuator 21 is at a released equilibrium position 19 (fully exposed from cavity 12) and the shaft 22 is at a retracted equilibrium position. Such a structural configuration provides the unexpected and unpredictable advantage of ensuring each grabbing member 28 is retracted in sync and returns to an original resting (equilibrium) position when not deployed.

In a non-limiting exemplary embodiment, referring to FIGS. 7-9*a*, each of the grabbing members 28 are angularly registered relative to the centrally registered longitudinal axis 13 when the actuator 21 is at a depressed tensioned position (pushed into cavity 12) and the distal end 15 of the shaft 22 is displaced outwardly away from the distal end 15 of the body 11. Such a structural configuration provides the unexpected and unpredictable advantage of enabling a user to grab around the target object and maintain sufficient surface area contact therewith during the object retrieval process. This can be especially useful when retrieving annular or spherical objects from space-confined areas.

In a non-limiting exemplary embodiment, each of the grabbing members 28 further includes a substantially triangular-shaped wedge 35 coupled to the interior surface 29 of the grabbing members 28 and radially extended towards the centrally registered longitudinal axis 13. Such a structural configuration provides the unexpected and unpredictable advantage of ensuring each grabbing member 28 returns to its original resting position (equidistantly offset from centrally registered axis 13).

In a non-limiting exemplary embodiment, each of the triangular-shaped wedges 35 has a lateral side 36 respectively conjoined and spaced apart from an adjacent one of the triangular-shaped wedges 35 when the grabbing members 28 are at the retracted equilibrium position 19 (FIGS. 1, 3-6*a*) and the expanded tensioned position 20 (FIGS. 7-9*a*), respectively. Such wedges 35 provide the unexpected and unpredictable advantage of ensuring the grabbing members 28 return to an equidistantly offset orientation substantially parallel to the centrally registered longitudinal axis 13. Such a structural configuration provides the unexpected and unpredictable advantage of preventing the grabbing members 28 from pivoting inwardly beyond their original resting position and maintains the equidistantly spaced configuration of the object-grabbing section 18.

The present disclosure further includes a method of utilizing a multi-functional walking cane 10 for assisting a user to reach and pick up objects that may be too high or on the floor. Such a method includes the chronological steps of: providing a body 11 including a cavity 12 having a centrally registered longitudinal axis 13, a proximal end 14 and a distal end 15 opposed therefrom, and a handle 16 disposed at the proximal end 14; providing an object-grabbing mechanism 17 having an object-grabbing section 18 seated exterior of the body 11; operably communicating the object-grabbing mechanism 17 with the body 11; and resiliently deploying the object-grabbing section 18 between a retracted equilibrium position 19 and an expanded tensioned position 20, respectively.

A non-limiting exemplary embodiment(s) of the present disclosure is referred to generally in FIGS. 1-9*a* and is intended to provide a multi-functional walking cane 10 featuring an object-grabbing mechanism 17 incorporated into the bottom thereof for assisting a user to reach and pick up items that may be too high or on the floor. It should be understood that the exemplary embodiment(s) may be used to pick up a variety of items, and should not be limited to any particular item described herein.

Referring to FIGS. 1-9*a* in general, in a non-limiting exemplary embodiment(s), a specially designed walking cane 10 has an object-grabbing mechanism 17 incorporated into the bottom of the unit. The multi-functional walking cane 10 may feature an attractive weather-resistant aluminum or wood outer casing, and feature the tubular, elongated design of these devices. Optionally measuring approximately 34 inches in length and ¾ of an inch in diameter, the multi-functional walking cane 10 may feature a hook-like hand-grip (handle 16) at the proximal end 14 of the body 11 designed expressly to facilitate a firm and comfortable hold during use. Partially located within the interior of the body 11 is object-grabbing mechanism 17. A non-skid fitted cap 44 can be secured over the distal end of object-grabbing mechanism 17 and removed prior to activating the object-grabbing mechanism 17.

A jaw-like object-grabbing section 18 preferably culminates in a series of three or four hinge-mounted prongs (e.g., grabbing members 28). Designed to expand (articulate) outwardly in a wide arc, and inwardly to a resting position, the object-grabbing section 18 is operated by a push button trigger (e.g., actuator 21), located adjacent to the handle 16. The object-grabbing section 18 is mounted to an extendable shaft 22 that emerges from the distal end 15 of the cane 10 on demand (e.g., user input), via the actuator 21. As such, the multi-functional walking cane 10 is utilized as a fully functioning walking cane 10, providing sturdy and reliable support to the user. In the event one needs to fetch an item out of reach or on the ground, he/she simply removes the end cap 44 from the distal end 15 of the cane 10. The user then need only press the trigger (actuator 21) to release/deploy the prongs (grabbing members 28), and place the object-grabbing section 18 over the target object. Releasing the actuator 21, the user is able to pinch closed (e.g., retract) the grabbing members 28 onto the target object, and simply bring it closer to the user for easy retrieval.

There are several significant benefits and advantages associated with this clever product invention. For example, the multi-functional walking cane 10 is safer and provides a more effective apparatus to retrieve objects that are out of reach. Offering the object-grabbing mechanism 17, which allows the user to remain upright at all times, this practical cane 10 alleviates the possibility that one may slip and fall when bending down or reaching upward for an elusive item. In this manner, users who depend on canes 10 to assist in walking will not have to worry about breaking bones or suffering serious injuries.

Weather-resistant, the multi-functional walking cane 10 is appropriate for either indoor or outdoor usage. Universal in construction, this versatile cane 10 is invaluable to those who need canes 10 to assist in their mobility. Ideal for use by children as well as adults, the easy to use multi-functional walking cane 10 is configured to be opened, gripped around a target object, and used to bring the object in easy reach, all in a matter of seconds.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A multi-functional walking cane for assisting a user to reach and pick up objects that may be too high or on the floor, said multi-functional walking cane comprising:

a body including a cavity having a centrally registered longitudinal axis, and a proximal end and a distal end opposed therefrom; and an object-grabbing mechanism being in operable communication with said body, said object-grabbing mechanism having an object-grabbing section seated exterior of said body;

wherein said object-grabbing section is configured to resiliently deploy between a retracted equilibrium position and an expanded tensioned position, respectively;

wherein said object-grabbing mechanism comprises an actuator extending out from said proximal end of said body;

a shaft having a proximal end seated within said cavity and connected to said actuator, said shaft further having a distal end provided with a serrated outer surface seated exterior of said body; and a resilient spring concentrically wound about said shaft, said spring being configured to compress to a tensioned position and thereafter automatically return to an expanded equilibrium position when said actuator is linearly displaced inwardly and outwardly from said shaft, respectively;

wherein said object-grabbing section is located at said distal end of said body and rotatably coupled to said serrated outer surface of said distal end of said shaft;

wherein said actuator, said spring and said shaft are contemporaneously reciprocated along the centrally registered longitudinal length of said body such that said grabbing section is pivotally displaced between said retracted equilibrium position and an expanded tensioned position, respectively;

wherein said object-grabbing section further comprises a plurality of grabbing members each having a curvilinear interior surface and a drive gear statically affixed thereto;

a plurality of brackets fixedly connected to said distal end of said body; and a plurality of pivot pins transversely interfitted through said drive gears respectively, and mated to said brackets, respectively;

wherein said grabbing members are equidistantly and symmetrically offset from the centrally registered longitudinal axis;

wherein each said drive gear maintains continuous contact with said serrated outer surface of said shaft.

2. The multi-functional walking cane of claim 1, wherein said grabbing members are contemporaneously pivoted in sync about said pivot pins and along mutually exclusive arcuate travel paths, respectively.

3. The multi-functional walking cane of claim 1, wherein each of said grabbing members are registered substantially parallel to the centrally registered longitudinal axis when said actuator is at a released equilibrium position and said shaft is at a retracted equilibrium position.

4. The multi-functional walking cane of claim 1, wherein each of said grabbing members are angularly registered relative to the centrally registered longitudinal axis when said actuator is at a depressed tensioned position and said distal end of said shaft is displaced outwardly away from said distal end of said body.

5. The multi-functional walking cane of claim 1, wherein each of said grabbing members further comprises: a substantially triangular-shaped wedge coupled to said interior surface thereof and radially extending towards the centrally registered longitudinal axis.

6. The multi-functional walking cane of claim 5, wherein each of said triangular-shaped wedges has a lateral side respectively conjoined and spaced apart from an adjacent one of said triangular-shaped wedges when said grabbing members are at the retracted equilibrium position and the expanded tensioned position, respectively.

7. A multi-functional walking cane for assisting a user to reach and pick up objects that may be too high or on the floor, said multi-functional walking cane comprising:

a body including a cavity having a centrally registered longitudinal axis, a proximal end and a distal end opposed therefrom, and a handle disposed at said proximal end; and an object-grabbing mechanism being in operable communication with said body, said object-grabbing mechanism having an object-grabbing section seated exterior of said body;

wherein said object-grabbing section is configured to resiliently deploy between a retracted equilibrium position and an expanded tensioned position, respectively;

wherein said object-grabbing mechanism comprises an actuator extending out from said proximal end of said body;

a shaft having a proximal end seated within said cavity and connected to said actuator, said shaft further having a distal end provided with a serrated outer surface seated exterior of said body; and a resilient spring concentrically wound about said shaft, said spring being configured to compress to a tensioned position and thereafter automatically return to an expanded equilibrium position when said actuator is linearly displaced inwardly and outwardly from said shaft, respectively;

wherein said object-grabbing section is located at said distal end of said body and rotatably coupled to said serrated outer surface of said distal end of said shaft;

wherein said actuator, said spring and said shaft are contemporaneously reciprocated along the centrally registered longitudinal length of said body such that said grabbing section is pivotally displaced between said retracted equilibrium position and an expanded tensioned position, respectively;

wherein said object-grabbing section further comprises a plurality of grabbing members each having a curvilinear interior surface and a drive gear statically affixed thereto;

a plurality of brackets fixedly connected to said distal end of said body; and a plurality of pivot pins transversely interfitted through said drive gears respectively, and mated to said brackets, respectively;

wherein said grabbing members are equidistantly and symmetrically offset from the centrally registered longitudinal axis;

wherein each said drive gear maintains continuous contact with said serrated outer surface of said shaft.

8. The multi-functional walking cane of claim 7, wherein said grabbing members are contemporaneously pivoted in sync about said pivot pins and along mutually exclusive arcuate travel paths, respectively.

9. The multi-functional walking cane of claim 8, wherein each of said grabbing members are registered substantially parallel to the centrally registered longitudinal axis when said actuator is at a released equilibrium position and said shaft is at a retracted equilibrium position.

10. The multi-functional walking cane of claim 9, wherein each of said grabbing members are angularly registered relative to the centrally registered longitudinal axis when said actuator is at a depressed tensioned position and said distal end of said shaft is displaced outwardly away from said distal end of said body.

11. The multi-functional walking cane of claim 10, wherein each of said grabbing members further comprises: a substantially triangular-shaped wedge coupled to said interior surface thereof and radially extending towards the centrally registered longitudinal axis.

12. The multi-functional walking cane of claim 11, wherein each of said triangular-shaped wedges has a lateral side respectively conjoined and spaced apart from an adjacent one of said triangular-shaped wedges when said grabbing members are at the retracted equilibrium position and the expanded tensioned position, respectively.

13. A method of utilizing a multi-functional walking cane for assisting a user to reach and pick up objects that may be too high or on the floor, said method comprising the steps of:

providing a body including a cavity having a centrally registered longitudinal axis, a proximal end and a distal end opposed therefrom, and a handle disposed at said proximal end;

providing an object-grabbing mechanism having an object-grabbing section seated exterior of said body;

operably communicating said object-grabbing mechanism with said body; and resiliently deploying said object-grabbing section between a retracted equilibrium position and an expanded tensioned position, respectively;

wherein said object-grabbing mechanism comprises an actuator extending out from said proximal end of said body;

a shaft having a proximal end seated within said cavity and connected to said actuator, said shaft further having a distal end provided with a serrated outer surface seated exterior of said body; and a resilient spring concentrically wound about said shaft, said spring being configured to compress to a tensioned position and thereafter automatically return to an expanded equilibrium position when said actuator is linearly displaced inwardly and outwardly from said shaft, respectively;

wherein said object-grabbing section is located at said distal end of said body and rotatably coupled to said serrated outer surface of said distal end of said shaft;

wherein said actuator, said spring and said shaft are contemporaneously reciprocated along the centrally registered longitudinal length of said body such that said grabbing section is pivotally displaced between said retracted equilibrium position and an expanded tensioned position, respectively;

wherein said object-grabbing section further comprises a plurality of grabbing members each having a curvilinear interior surface and a drive gear statically affixed thereto;

a plurality of brackets fixedly connected to said distal end of said body; and a plurality of pivot pins transversely interfitted through said drive gears respectively, and mated to said brackets, respectively;

wherein said grabbing members are equidistantly and symmetrically offset from the centrally registered longitudinal axis;

wherein each said drive gear maintains continuous contact with said serrated outer surface of said shaft.

* * * * *